US007621017B2

(12) United States Patent
Cornelissen

(10) Patent No.: US 7,621,017 B2
(45) Date of Patent: Nov. 24, 2009

(54) PAINT ROLLER TRAY PROVIDED WITH TWO SURFACES FOR ROLLING PAINT OFF A ROLLER

(76) Inventor: Rudolphus Johannes Adrianus Maria Cornelissen, Wieken 43, 5374 JT Schaijk (NL)

( * ) Notice: Subject to any disclaimer, the term of this patent is extended or adjusted under 35 U.S.C. 154(b) by 87 days.

(21) Appl. No.: 11/893,119

(22) Filed: Aug. 14, 2007

(65) Prior Publication Data

US 2008/0040881 A1 Feb. 21, 2008

(51) Int. Cl.
*B44D 3/12* (2006.01)
*B65D 1/24* (2006.01)

(52) U.S. Cl. ..... 15/257.06; 220/570

(58) Field of Classification Search ..... 15/257.05, 15/257.06; 220/570
See application file for complete search history.

(56) References Cited

U.S. PATENT DOCUMENTS 4,164,803 A * 8/1979 Zurawin et al. ..... 15/257.05
4,547,926 A 10/1985 Kern
4,669,609 A * 6/1987 Lugo ..... 206/229
4,765,123 A 8/1988 Caldwell
4,815,604 A 3/1989 O'Neil et al.
5,156,411 A * 10/1992 Owens ..... 280/79.2
D355,287 S * 2/1995 Camp, Jr. ..... D32/53.1
5,511,279 A * 4/1996 Ippolito ..... 15/257.06
5,735,399 A * 4/1998 Ste. Marie ..... 206/362
D428,540 S * 7/2000 Grant ..... D32/53.1
6,493,901 B1 * 12/2002 Jones ..... 15/257.06
D518,263 S * 3/2006 Verhaar ..... D32/53.1
2001/0013518 A1 8/2001 Lallement et al.

FOREIGN PATENT DOCUMENTS

CA 1187045 A1 5/1985
DE 2455015 A1 5/1976
FR 974500 A 2/1951

* cited by examiner

*Primary Examiner*—Randall Chin

(57) ABSTRACT

A paint roller tray has a bottom with two upright side walls, a front wall and a rear wall along its periphery. The front wall slopes forward and is provided with ribs on the inner side making it a surface for rolling paint off a roller. The bottom, furthermore, has a front bottom section and a rear bottom section as well as a middle section connecting the two. The front bottom section of the paint roller tray is deeper than the rear bottom section. The rear bottom section is also provided with ribs and is an additional surface for rolling paint off a roller.

2 Claims, 2 Drawing Sheets

PAINT ROLLER TRAY PROVIDED WITH TWO SURFACES FOR ROLLING PAINT OFF A ROLLER

BACKGROUND OF THE INVENTION

1. Field of the Invention

The invention relates to a paint roller tray provided with a bottom having two upright side walls, a front and a rear wall along its periphery, which paint roller tray is, furthermore, provided with two surfaces with ribs, over which a paint roller can be rolled to remove excess paint from it, of which surfaces one is the inner side of the front wall and the other is the top side of a mainly horizontal wall.

2. Description of Related Art

The following art defines the present state of this field:

Such a paint roller tray is known from the Canadian patent application CA 2.091.797. With this well-known paint roller tray, the practically horizontal wall, the top side of which is the other surface for rolling off paint, is situated on the top edge of the front wall and extends outwards from the front wall. This well-known paint roller tray is, furthermore, provided with a handle and can be used when hanging from the handle by rolling the paint roller over the sloping front wall instead of over the practically horizontal wall. Because of this, the paint roller tray will not tip over when rolling a paint roller, where the roller is pressed on the surface. The disadvantage of this well-known paint roller tray is that the bottom and the practically horizontal wall that is the other surface for rolling paint off a roller lie in the same direction, as a result of which the paint roller tray is relatively long and because of that difficult to handle.

SUMMARY OF THE INVENTION

The present invention teaches certain benefits in construction and use which give rise to the objectives described below.

An objective of the invention is to provide a paint roller tray of the type described in the preamble which is easier to handle than the well-known paint roller tray. To this end, the paint roller tray according to the invention is characterised in that the bottom comprises a front bottom section adjoining the front wall and a rear bottom section adjoining the rear wall, as well as a middle section connecting the two bottom sections, in which the front bottom section of the paint roller tray is deeper than the rear bottom section and where the mainly horizontal wall, the upper side of which is the other surface, is the rear bottom section. The other surface is thus a part of the bottom, as a result of which this other surface does not lie in the same direction as the bottom and the paint roller tray according to the invention is shorter than the known paint roller tray and therefore easier to handle.

It is noted that a paint roller tray provided with a front bottom section that is deeper than the rear bottom section, provided with a surface for rolling off paint, is generally known. However, this generally known paint roller tray only has one surface for rolling off paint and the front wall of this paint roller tray is just as steep as the other walls. If this generally known paint roller tray were to be combined with the well-known paint roller tray in the Canadian patent application CA 2.091.797 the bottom section, which is provided with a surface, would adjoin the front side, which is also provided with such a surface, so that just as in the well-known paint roller tray in the Canadian patent application CA 2.091.797 these two surfaces would adjoin each other. Such a paint roller tray obtained through this combination has the disadvantage that the bottom section which is situated lower and where the paint reservoir is, is situated on the other side of the handle opposite the surface for rolling paint off a roller on the front wall. Because of this, using the surface is difficult because after the roller has been dipped in the paint, it has to be brought over the handle in order to roll off excess paint on the steep surface.

In order to be able to roll over the front wall more easily, the front wall is preferably not as steep as the other walls.

An embodiment of the paint roller tray according to the invention is characterised in that there is an elongated slot situated in or on the side wall, near the top edge of each side wall of the paint roller tray in which while cooperating with a handle, which comprises a U-shaped strip, the free ends of which are provided with hooks, the hooks are inserted in the slots situated in the paint roller tray and the handle cannot twist with respect to the paint roller tray.

By providing the paint roller tray with slots that cooperate with the ends of a handle, in which the ends of the handle have a shape such that they cannot twist in the slots, the paint roller tray cannot tilt while hanging on such a handle. Because of this the paint roller tray can easily be held by one hand and in a horizontal position.

Preferably, the slots extend longitudinally in the side walls, in order to cooperate with the ends of a handle with an elongated cross-section.

A further embodiment of the paint roller tray according to the invention is characterised in that the upper edge of the front wall is flanged outwards and is provided with a Ω-shaped recess in the flanged part. A magnetic paintbrush holder can be clicked into this recess. A magnetic paintbrush holder hat is particularly suitable for use here, is described in the not previously published Dutch patent application no. 1028745.

Preferably, the opening in the Ω-shaped recess is not exactly in the middle in order to be able to place a paintbrush holder more easily in the recess. The paintbrush holder can then be shoved into the long part of the recess and after that shoved back into the short part of the recess so that the paintbrush holder is centred in the opening.

In order to prevent the magnetic paintbrush holder from tilting about the edge of the paint roller tray's front wall, the front wall is provided with an upright lip on the top edge where the Ω-shaped recess is situated, which lip extends upwards from the front wall.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

Figure 1:
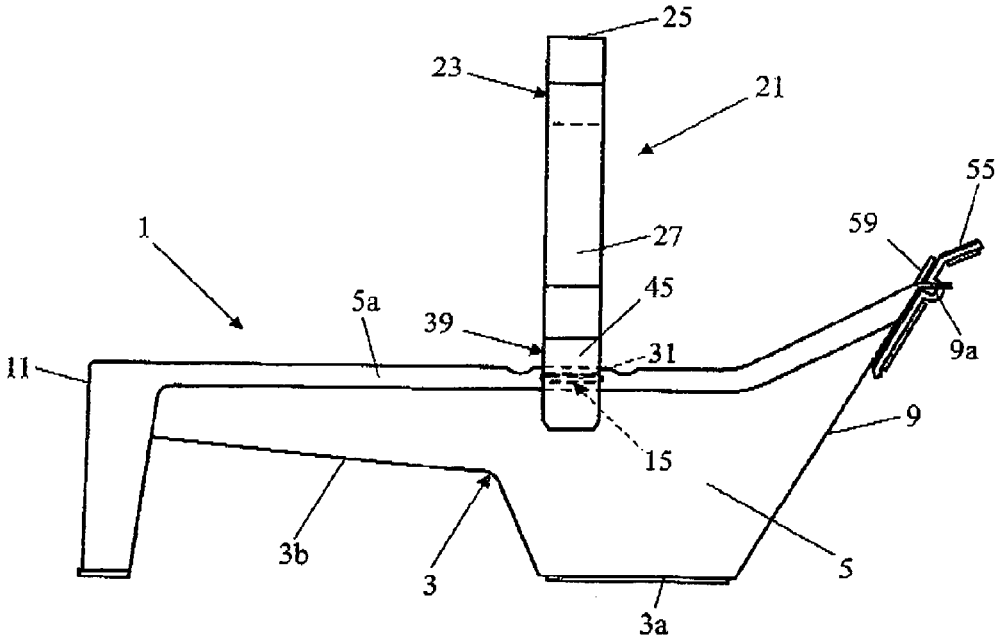
FIG. 1 is a side view of an embodiment of the paint roller tray according to the invention with a handle coupled to it.
Figure 2A:
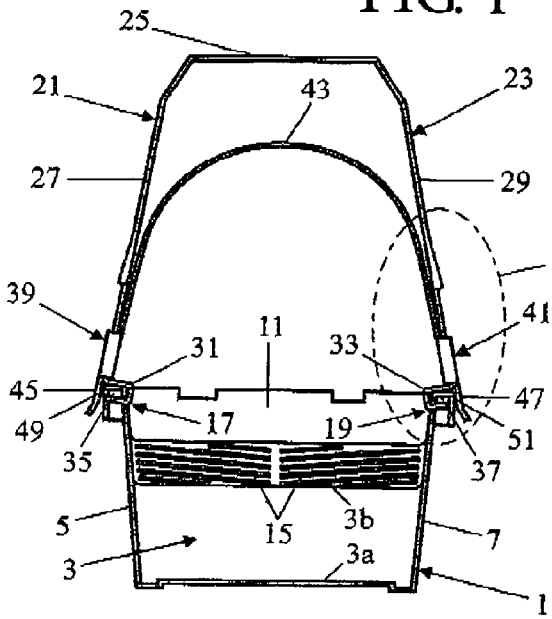
FIG. 2A is a cross-section of the paint roller tray shown in FIG. 1 with the handle coupled to it.
Figure 2B:
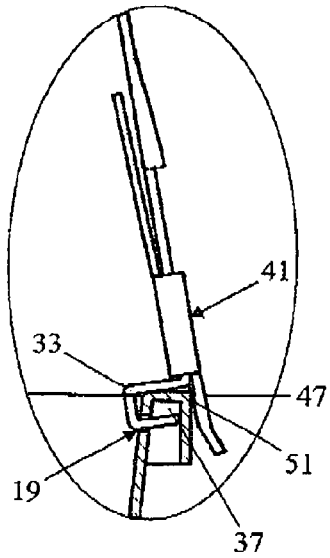
FIG. 2B is an enlarged portion of the paint roller tray of FIG. 2A.

In FIGS. 1, 2A, and 2B, an embodiment of the paint roller tray 1 according to the invention, with a handle coupled to it, is shown in a side view and cross-section respectively. The paint roller tray 1 has a bottom 3 with two upright side walls 5, 7, a front wall 9 and a rear wall 11 along its periphery. The front wall 9 slopes forward and is provided with ribs 13 as a result of which this side is a surface for rolling paint off a roller.

The bottom 3 has a front bottom section 3*a* and a rear bottom section 3*b* as well as a connecting middle section between the two. The front bottom section 3*a* of the paint roller tray is deeper than the rear bottom section 3*b*. The rear bottom section 3*b* is also provided with ribs 15 and an additional surface for rolling paint off a roller.

In both side walls 5 and 7 situated opposite each other, there are two elongated slots 17, 19, which lie directly opposite each other near the top edge.

The handle 21 has a U-shaped strip 23 with a middle section 25 that acts as a handgrip and two arms 27 and 29 connected to it. The free ends of the arms are provided with hooks 31, 33, which with the openings 35, 37 are turned outwards. Furthermore, the handle has two locking elements 39 and 41, which are connected to each other by way of a strip 43 and which can be placed in front of the openings 35, 37 of the hooks. The locking elements are locking bands 45, 47 that can be slid along the strip's arms, which are provided with a projecting ridge 49, 51 turned towards the strip 23.

The ends of the hooks 31, 33 of the handle have an elongated cross-section and are inserted in the slots 17, 19 of the paint roller tray 1, and the projecting ridges 49, 51 of the handle catch behind the flanged upper edges 5*a* and 7*a* of the side walls 5, 7.

Figure 3:
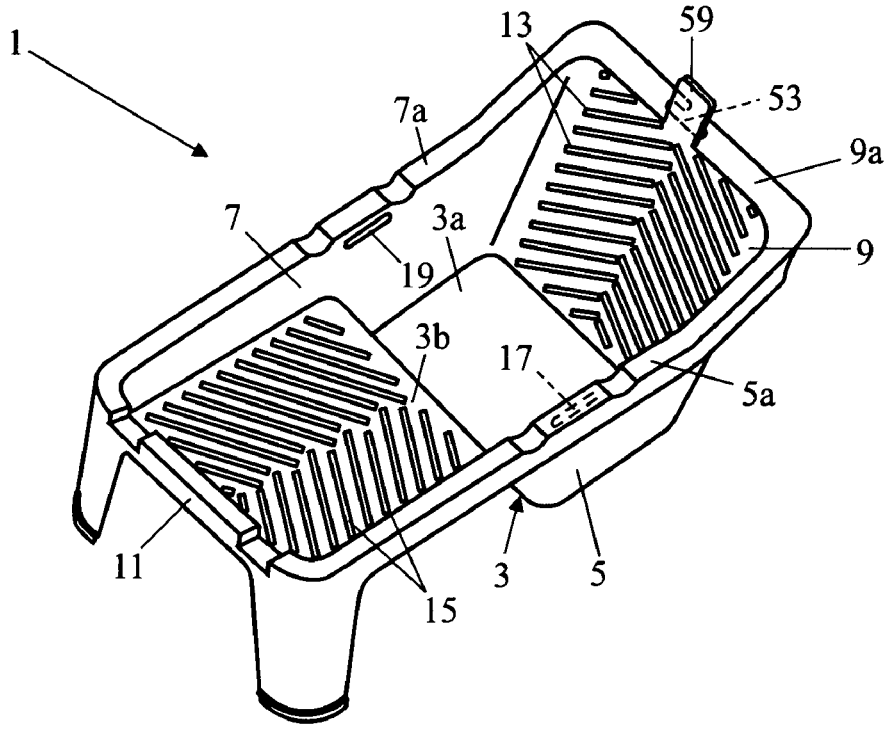
FIG. 3 is a perspective view from above of the paint roller tray shown in FIG. 1.
Figure 4:
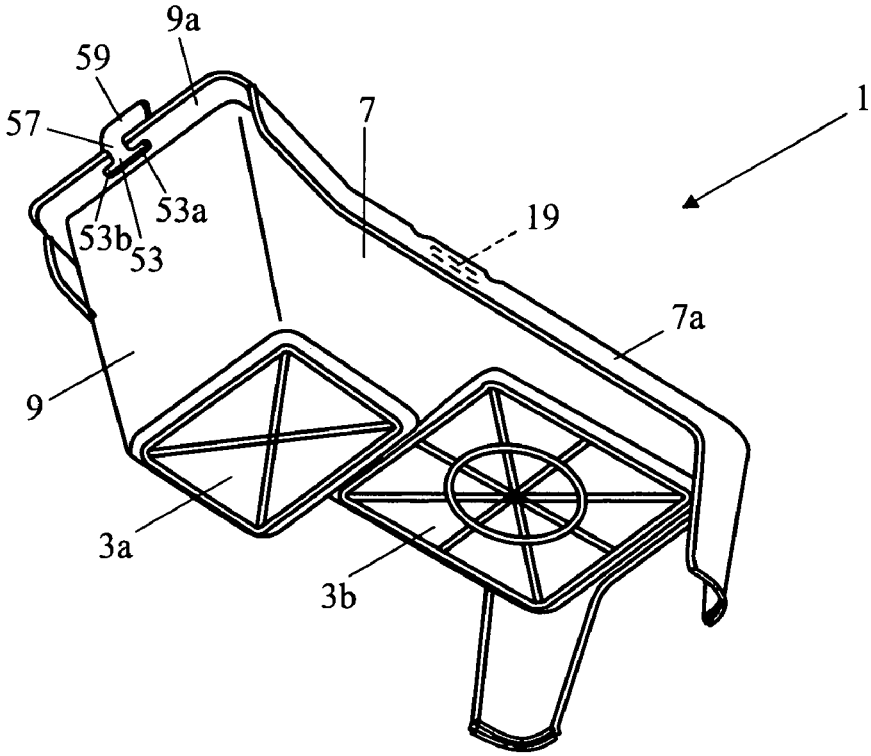
FIG. 4 is a perspective view from underneath the paint roller tray shown in FIG. 1.

In FIGS. 3 and 4 the paint roller tray 1 is shown separately in perspective views from above and from underneath respectively. The upper edge 9*a* of the front wall 9 that is flanged outwards is provided with a Ω-shaped recess 53. A strip-shaped magnetic paintbrush holder 55 can be clicked into this recess 53 (see FIG. 1). The opening 57 in the Ω-shaped recess 53 is not exactly in the middle. The paintbrush holder 55 can be shoved first in the long parts 53*a* and 53*b* of the recess and then shoved back into the short part of the recess so that the paintbrush holder is centered in the opening and cannot come out of the recess 53 by accident.

In order to prevent the magnetic paintbrush holder 55 from tilting about the edge of the front wall 9 of the paint roller tray 1, the front wall is provided with a lip 59 by the Ω-shaped recess 53. This lip 59 extends upwards from the front wall 9.

Although in the above the invention is explained on the basis of the drawings, it should be noted that the invention is in no way limited to the embodiment shown in the drawings. The invention also extends to all embodiments deviating from the embodiment shown in the drawings within the context defined by the claims.

The terminology used in the specification provided above is hereby defined to include similar and/or equivalent terms, and/or alternative embodiments that would be considered obvious to one skilled in the art given the teachings of the present patent application. Additionally, the words "a," "an," and "one" are defined to include one or more of the referenced item unless specifically stated otherwise. Also, the terms "have," "include," "contain," and similar terms are defined to mean "comprising" unless specifically stated otherwise.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A paint roller tray for use with a paint roller, the paint roller tray comprising:

a bottom wall with two upright side walls, a front and a rear wall along its periphery;

two surfaces with ribs, over which the paint roller can be rolled to remove excess paint from it;

an inner side of the front wall upon which is formed one of the two surfaces with ribs a mainly horizontal wall upon which is formed another of the two surfaces with ribs;

a bottom comprising a front bottom section adjoining the front wall and a rear bottom section adjoining the rear wall, as well as a middle section in between connecting both bottom sections, in which the front bottom section of the paint roller tray is deeper than the rear bottom section and where the mainly horizontal wall, the top side of which is the other surface for rolling off paint, is the rear bottom section; and wherein the upper edge of the front wall includes a flanged part and is provided with a Ω-shaped recess in the flanged part.

2. Paint roller tray according to claim 1, characterized in that the front wall is provided with an upright lip on a top edge where the Ω-shaped recess is situated, the upright lip extending upwardly from the front wall.

* * * * *